US008058572B2

(12) United States Patent
Bastholm et al.

(10) Patent No.: US 8,058,572 B2
(45) Date of Patent: Nov. 15, 2011

(54) ELECTRICAL ACTUATOR SYSTEM

(75) Inventors: Jeppe C. Bastholm, Sønderborg (DK); Jan Frohlich, Sønderborg (DK)

(73) Assignee: Linak A/S, Nordborg (DK)

( * ) Notice: Subject to any disclaimer, the term of this patent is extended or adjusted under 35 U.S.C. 154(b) by 330 days.

(21) Appl. No.: 12/312,484

(22) PCT Filed: Nov. 15, 2007

(86) PCT No.: PCT/DK2007/000506

§ 371 (c)(1),
(2), (4) Date: May 13, 2009

(87) PCT Pub. No.: WO2008/058544

PCT Pub. Date: May 22, 2008

(65) Prior Publication Data

US 2010/0059353 A1 Mar. 11, 2010

(30) Foreign Application Priority Data

Nov. 15, 2006 (DK) ..... 2006 01498

(51) Int. Cl.
*H01H 13/72* (2006.01)

(52) U.S. Cl. ..... 200/5 A

(58) Field of Classification Search ..... 362/30; 345/87; 200/5 A

See application file for complete search history.

(56) References Cited

U.S. PATENT DOCUMENTS

| | | | | |
|---|---|---|---|---|
| 4,324,986 | A | 4/1982 | Hara et al. | |
| 6,092,903 | A | 7/2000 | Higgins | |
| 6,140,987 | A | 10/2000 | Stein et al. | |
| 7,417,624 | B2 * | 8/2008 | Duff | 345/168 |
| 7,631,579 | B2 * | 12/2009 | Johnson et al. | 81/53.12 |
| 2001/0013395 | A1 * | 8/2001 | Pourmand et al. | 156/555 |
| 2005/0073446 | A1 | 4/2005 | Lazaridis et al. | |

FOREIGN PATENT DOCUMENTS

| | | |
|---|---|---|
| DE | 9318083 | 3/1994 |
| DE | 19501976 | 8/1995 |
| DE | 19529962 | 2/1996 |
| EP | 0470403 | 2/1992 |

OTHER PUBLICATIONS

English Abstract of DE 19501976.
English Abstract of EP 0470403.
English Abstract of DE 19529962.

* cited by examiner

*Primary Examiner* — Anabel Ton
(74) *Attorney, Agent, or Firm* — Dykema Gossett PLLC

(57) ABSTRACT

An electrical actuator system, especially for adjustable articles of furniture, comprising at least one electric actuator for bringing about the adjustment, a mains based power supply and possibly also rechargeable batteries, a control unit and a hand (10) control with at least one key (17) of a transparent material and/or an area of transparent material surrounding the key. Inside the hand control (10) is a light source located in connection with the transparent material (16). A control of the light source is embodied so that the light source always emits a basic lighting and by touch, movement or activation of a key, the light source is brought to emit an actual operating lighting of the keys.

8 Claims, 3 Drawing Sheets

ELECTRICAL ACTUATOR SYSTEM

BACKGROUND OF THE INVENTION

1. Field of the Invention

The present invention relates to an electrical actuator system, especially for use with adjustable articles of furniture, which includes at least one electric actuator for bringing about the adjustment, a mains based power supply and possibly also rechargeable batteries, a control unit and a hand control with at least one key of a transparent material and/or an area surrounding the key which is of a transparent material, and a light source located inside the hand control in conjunction with the transparent material.

2. The Prior Art

With electrically adjustable articles of furniture there is a particular complex of problems when it comes to hand controls with background lighting, as it often occurs that the article of furniture is not constantly connected to mains power supply. Intensified price incentive, the background lighting has, for that reason, typically been left out.

Hand controls with lighting for background lighting of the keys are known cf. for instance DE 195 29 962 C2 Dietmar Koch (OKIN). Unlike hand controls with constant background lighting of the keys, this publication DE 195 29 962 C2 discloses a hand control where the light is normally off and is not switched on until the moment when the hand control is used. The light can be switched on as a result of the operation of a key, alternatively by touch, as it is equipped with a touch sensor, and finally, alternatively, when the hand control is moved, as a movement sensor is built in.

Hand controls with constant lighting are easier to locate in the dark; on the other hand the light may also appear annoying. The hand control also requires a constant energy supply of a certain size in order to light up the keys. The other type of hand controls where the light is not switched on until the hand control is activated has the disadvantage of being difficult to locate in the dark.

The object of the invention is to provide a hand control with improved user properties and which is not so energy demanding.

SUMMARY OF THE INVENTION

This is achieved according to the invention with a hand control which includes a light source for illuminating one or more keys thereof and control circuitry for causing the light source to emit a subdued light level when the hand control is not in use and an operating (elevated) light level when the hand control is touched or moved, or a key is activated. The hand control thus has a subdued basic lighting so that it is easy to locate in the dark without otherwise seeming annoying. Further, a subdued basic lighting is not very energy demanding. When activating the hand control, the control unit ensures that the light changes to the stronger operating lighting, where the keys are actually lit up. For activating the operating lighting, activation of a separate key or an operating key can be used, but some form of touch or movement sensors is preferred, so that the light is switched to operating lighting by the mere touch or movement of the hand control. The control unit is moreover embodied so that the operating lighting is on in a certain period of time, before falling back to the reduced basic lighting. The background lighting requires constant connection to a power source, but it does not necessarily have to be the mains based main power supply, thus it is here possible to use rechargeable batteries or capacitors as power source for the background lighting.

Expediently, the basic lighting and the operating lighting is constituted by a common light source, which by the basic lighting is powered with a lower voltage and/or current corresponding to lower energy than by the operating lighting. Hereby a set of light sources is saved and thus simplifying the construction. The light source is preferably constituted by one or more light emitting diodes, which are not very energy demanding, while they takes up but little space and have small dimensions.

Expediently, the actuator comprises a first constant voltage generator for the basic lighting and a second constant voltage generator for the operating lighting, which is simple and sturdy. They could be made so that they operate the basic and operating lighting respectively, but by the operating lighting, the light source is expediently powered both by the first and the second constant voltage generator.

In the period of time when the hand control is being operated, it is expedient that it emits the operating lighting constantly and in order to attain this, the actuator system comprises a timer for belated switching off the operating lighting, so that it will not go out every time an operating key is released. The timer can be realized in various ways, but is expediently constituted by an analogous circuit.

An embodiment for the invention will be described in the following with reference to the accompanying drawing.

DETAILED DESCRIPTION OF THE PREFERRED EMBODIMENT

Figure 1:
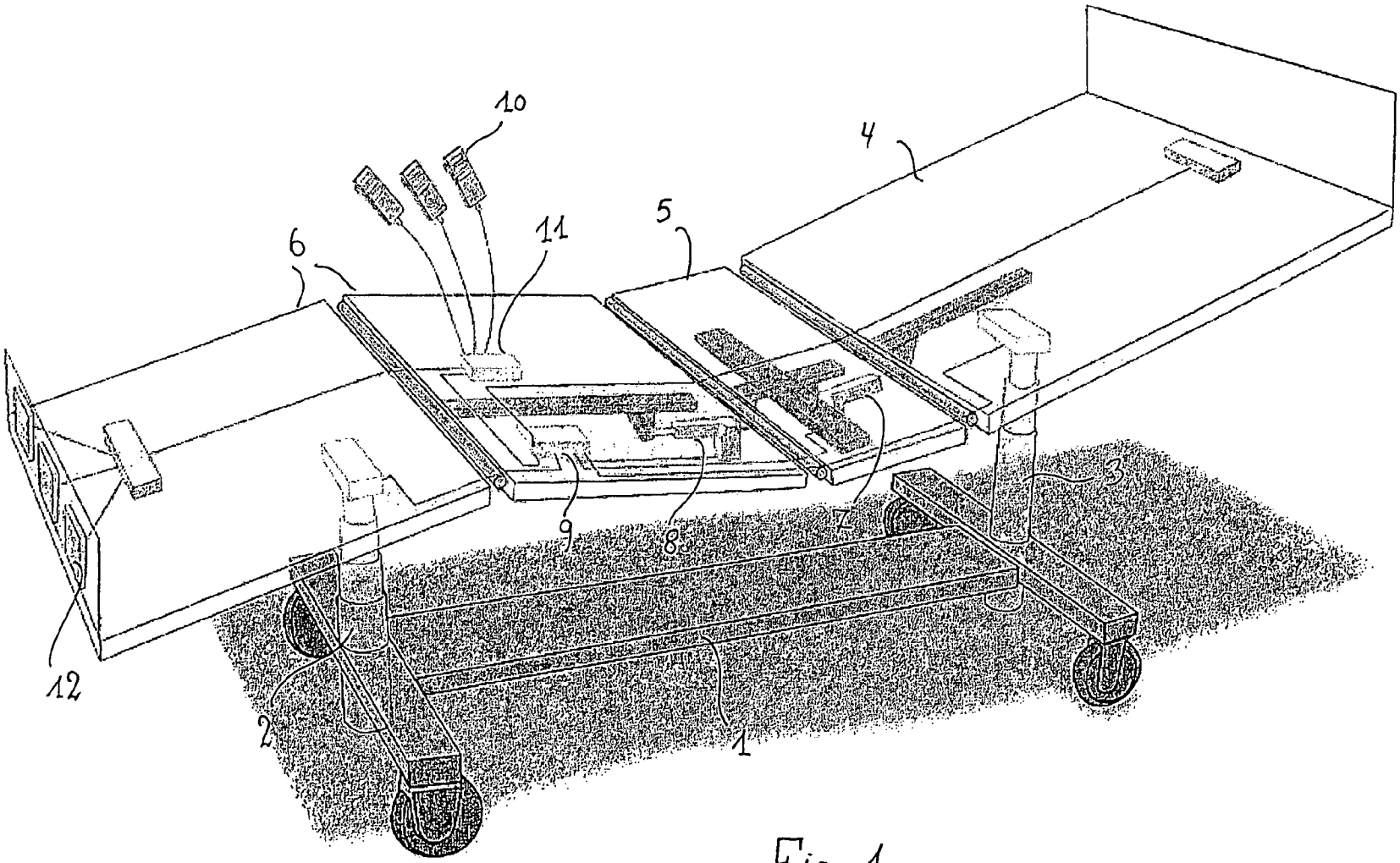
FIG. 1 shows a stylized view of an adjustable bed equipped with an actuator system according to the invention.

The bed shown in FIG. 1 comprises a lower frame 1, with drive wheels and equipped with a telescopic column 2, 3 at each end driven by a built-in linear actuator. The columns carry an upper frame, not shown, wherein is mounted a support surface for a mattress. The support surface is constituted by a back rest section 4, a fixed middle section 5 and an articulated leg rest section 6. The back and leg rest section 4,6 may be adjusted with a linear actuator 7, 8 each. The actuators are connected to a control box 9 comprising a mains based power supply, a rechargeable battery package and a control unit. To the control box is connected one or more hand controls 10 via a distribution box 11, just as fixed operating panels 12 can be located at the foot of the bed.

Figure 2:
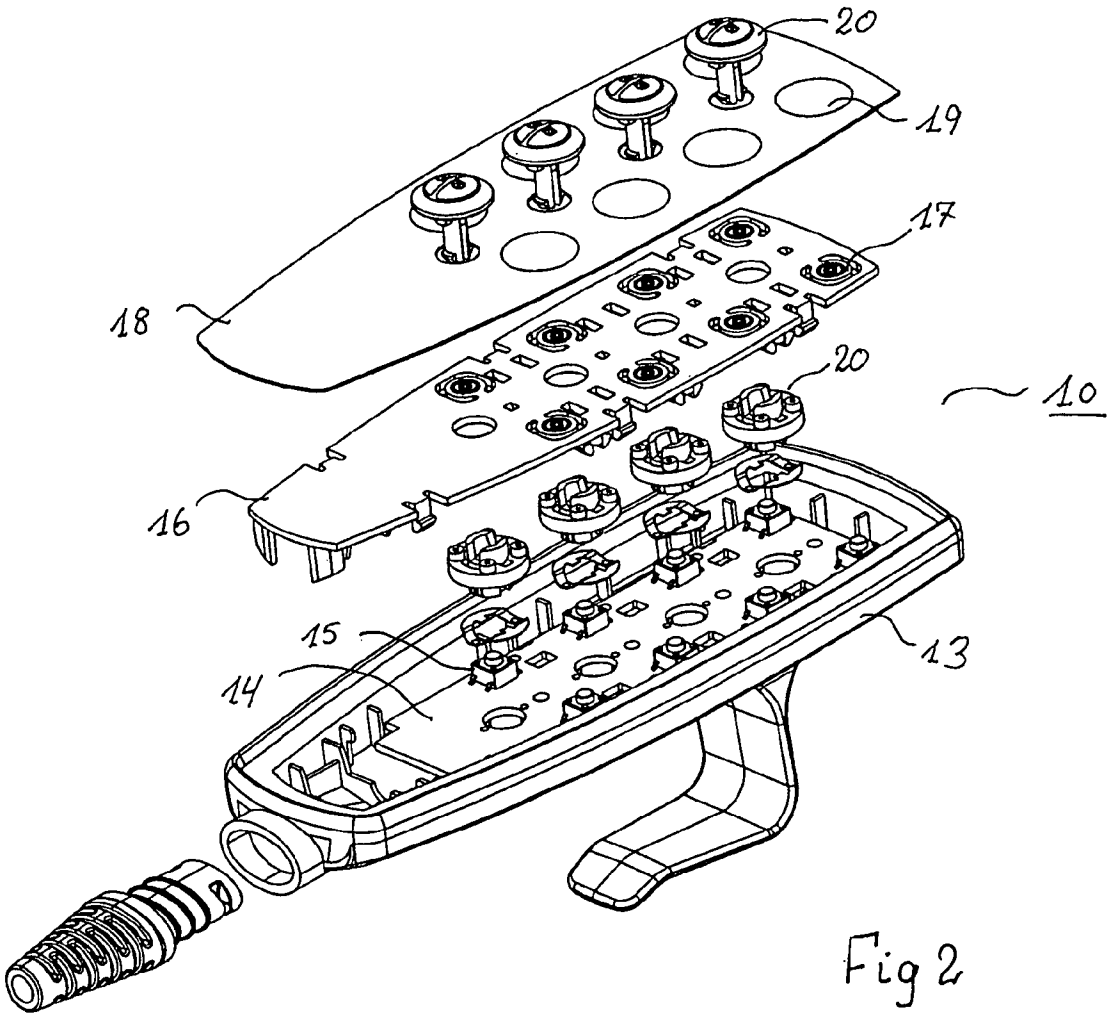
FIG. 2 shows an exploded view of a hand control.
Figure 3:
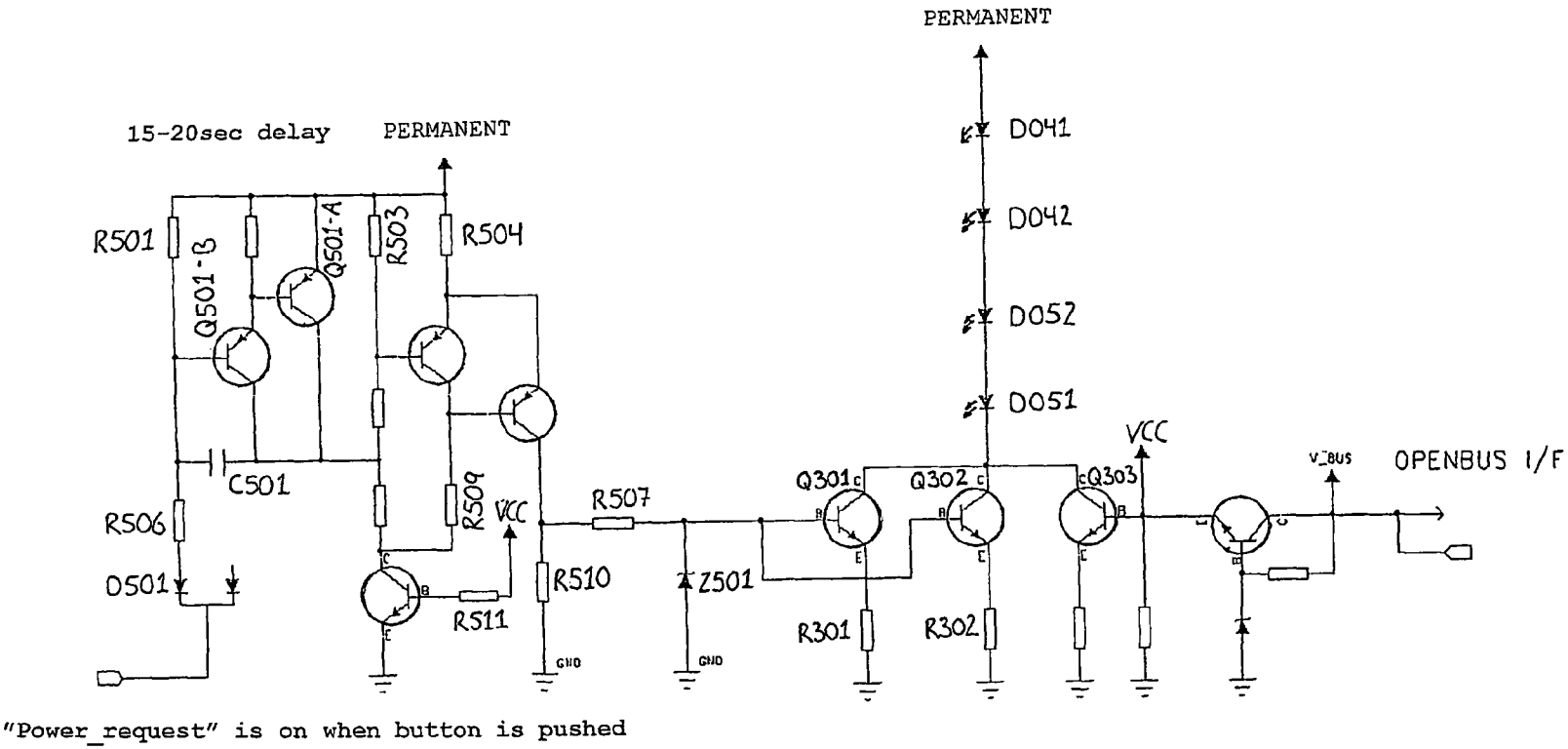
FIG. 3 shows a diagram of the CIRCUITRY FOR THE background lighting.

As shown in FIG. 2, the control shown in FIG. 1 comprises a plastic shell 13, wherein a printed circuit board 14 with switches 15 is inserted for activation of the actuators. Above is a plate 16 of transparent plastic with key bricks 17, which with a stem is resiliently connected to the plate so that they can be pressed inwards for activation of the switch 15 below. Above the transparent plate 16 is placed a cover foil 18 with indications 19, indicating the key bricks 17. The indications are constructed transparently, while the rest of the foil is constructed light impervious. The keys can be locked in pairs with a particular locking arrangement 20. On the printed circuit board 14, in connection with the indications 19 for the keys, are light-emitting diodes D051, D052, D042, D041 indicated in the diagram in FIG. 2 for lighting of the keys when emitting light through the indications 19 with a basic lighting and with an operating lighting.

With a first constant voltage generator based on Q303, the constant basic lighting is emitted. When activating one of the switches 15 on the hand control, another constant voltage generator, based on the transistor couple Q301, 302, is activated for emitting the operating lighting. The operating lighting is left on for a short period of time after the switch has been released with a timer based on the capacitor C501.

In greater detail, the circuit functions as follows: The transistor Q503 will, with the basis voltage from VCC via the resistance R511, be switched on, for which reason, the collector can be considered connected to ground GND.

The hand control is connected to the circuit by "Power request". When "Power request" is activated "active low", it means that a current runs from "permanent" via the resistance R506 and the light emitting diode D501 through the transistors Q501. By that means basis is driven low on the transistor Q501-B and, with a cascade connection to Q501-A, a current amplification is obtained, which momentarily connects the capacitor C501 with V-permanent in one end to V-permanent minus two times the diode transition in the transistor Q501, which all together constitutes about 1 volt in the other end.

As long as "Power request" is held low, the base voltage on the transistor Q502-A is kept close to V-permanent. This means that a current can run through the resistance R504 and on through the emitter for basis on the transistor Q502-B and for ground GND via the resistance R509. This will mean that a greater current runs through the resistance R504 and on through the emitter for the collector on the transistor Q502-B. This will power the network consisting on the resistances R510, R507 and the Zener diode Z501. The emitter resistance R301 (R302) will, with the Zener diode, cause the transistors Q301 and Q302 to function as constant voltage generators. The current in the individual transistor will be ((Vzener—Vbe)/Re) which in this case is 3.3 mA and, as we are dealing with two parallel steps, it is 6.6 mA, while the transistor Q303 also functions as constant voltage generator and provides a contribution of about 1 mA. This contribution is always there when VCC is present and makes the light-emitting diodes send out a feeble light at all times.

When "Power request" again is switch off, the transistor couple Q501A,Q501B will close. At the same time, the capacitor C501 will, with its voltage of about one volt, be preserved. When the capacitor C501 subsequently is charged through the resistance R501, the voltage over the resistance R503 will increase and at some point activate the transistor Q502-A, which will start to increase the voltage on basis of the transistor Q502-B, whereupon this will close. This will mean that the transistors Q301 and Q302 will cut off the current for the light-emitting diodes, which will then only have the contribution from the transistor Q303.

Lastly, it is noted that the actuator system is controlled with a bus system as described in WO 2007/057014 A1 Linak A/S, which in the diagram is indicate with OPENBUS I/F.

The invention claimed is:

1. A combination of an article of furniture which includes an adjustable part and an electrical actuator system for moving said adjustable part, said electrical actuator system comprising:

an electric actuator connected to said adjustable part, a control box electrically connected to said electric actuator, said control box containing a mains-based power supply and a control unit, and a hand control electrically connected to said control unit, said hand control including a key comprised of a transparent material or surrounded by a transparent area, a light source for backlighting said key or said transparent area, and circuitry for controlling said light source so as to emit a subdued basic lighting at all times except when the hand control is touched or moved, or the key activated, when the light source is caused to emit an elevated, operating lighting of the key or transparent area.

2. The combination according to claim 1, wherein the basic lighting and the operating lighting is constituted by a common light source, which by the basic lighting is powered with a lower energy (voltage, ampere) than by the operating lighting.

3. The combination according to claim 1, wherein the light source is constituted by one or more light-emitting diodes.

4. The combination according to claim 1, wherein the circuitry includes a first constant voltage generator for the basic lighting.

5. The combination according to claim 1, wherein the circuitry includes a second constant voltage generator for the operating lighting.

6. The combination according to claim 5, wherein by basic lighting the light source is powered by both the first and the second constant voltage generator.

7. The combination according to claim 1, wherein the circuitry includes a timer for delayed switching off the operating lighting.

8. The combination according to claim 7, wherein the timer is constituted by an analogous circuit.

* * * * *